United States Patent [19]

Ollivier et al.

[11] 4,349,141

[45] Sep. 14, 1982

[54] PISTON RETURN FOR POWDER ACTUATED PISTON TOOL

[75] Inventors: Jean Ollivier; Yves Bosch, both of Valence, France

[73] Assignee: Olin Corporation, New Haven, Conn.

[21] Appl. No.: 158,952

[22] Filed: Jun. 12, 1980

[51] Int. Cl.[3] ..... B25C 1/14; B25C 1/18

[52] U.S. Cl. ..... 227/10; 227/9

[58] Field of Search ..... 227/8, 9, 10, 11

[56] References Cited

U.S. PATENT DOCUMENTS

| | | | |
|---|---|---|---|
| 2,872,682 | 2/1959 | Maier | 227/10 |
| 3,066,302 | 12/1962 | De Caro et al. | 227/9 |
| 3,239,121 | 3/1966 | Kopf et al. | 227/10 |
| 3,357,617 | 12/1967 | Osborne | 227/10 |
| 3,409,197 | 11/1968 | Brack | 227/10 |
| 3,471,074 | 10/1969 | Rosselet | 227/10 |
| 3,556,381 | 1/1971 | Brack | 227/11 |

*Primary Examiner*—Paul A. Bell

*Attorney, Agent, or Firm*—Paul J. Lerner

[57] ABSTRACT

The piston return mechanism for a powder actuated piston-type fastener driving tool utilizes a tilting muzzle bushing to engage the fastener driving face of the piston. After the piston has been driven, the muzzle bushing is displaced manually forwardly, by means of a slide, until the muzzle bushing tilts to a position where it can contact the fastener driving face of the piston. The muzzle bushing is then returned breechwardly, pushing the piston in front of it back into the barrel bore to a driving position. When the driving position of the piston is reached, the muzzle bushing cams out of the tilted position into a position where it is coaxial with the piston.

7 Claims, 5 Drawing Figures

PISTON RETURN FOR POWDER ACTUATED PISTON TOOL

This invention relates to a powder actuated fastener driving tool of the piston-type, and, more particularly, to a mechanism for returning the piston from its driven position to its driving position.

Piston-type powder actuated fastener driving tools are well known in the prior art. These tools include a barrel having a bore, a muzzle end, and a firing chamber or breech end. A piston or ram is reciprocally slidably mounted in the barrel bore, and movable therein between a breechward driving position and a muzzleward driven position. The fastener to be driven is disposed in the muzzle end of the tool, and a blank cartridge or other power load is positioned in the firing chamber. With the piston in the driving position, the cartridge is fired producing high pressure combustion gases which propel the piston through the barrel bore from the driving position to the driven position. When the piston is thus driven through the barrel bore it accelerates the fastener and drives the fastener into the work surface, which may be masonry, steel, or the like.

Obviously, each time the tool is used to drive a fastener, the piston must be returned from its driven position to its driving position so that the next fastener may be driven. This piston returning operation has been accomplished in the prior art in a number of different ways. By far the most widely accepted and used piston return mechanism is shown in U.S. Pat. No. 3,066,302 to Charles De Caro. This return mechanism involves the use of a pawl which is fixed to the tool housing and extends through a slot in the barrel into the barrel bore where it can engage the piston. The barrel is reciprocally slidably mounted in the tool housing, and the pawl is muzzleward of the piston. After the tool is fired, the barrel is grasped and pulled muzzleward with respect to the housing. The pawl, being fixed, thus engages the piston and stops it from moving with respect to the housing. Thus the barrel is slid over the retained piston causing the latter to be returned to the breech end of the barrel bore.

In addition to the above, various other piston return procedures have been utilized in the prior art. These include the use of a rod pushed into the muzzle end of the tool to engage the driving face of the piston and whereby the piston is pushed breechward back to its driving position. A new fastener inserted into the tool muzzle may also be used to return the piston to a cetain degree. A slidable pawl has also been used to return the piston, the pawl being reciprocally mounted on the barrel and slidable through an axial barrel slot. Another piston return mechanism utilizes an inner sleeve which houses the piston and which can be withdrawn through the breech of the tool to allow the piston to be pushed back through the sleeve to a driving position. The sleeve is then reinserted into the barrel bore through the breech end of the tool.

One important condition which is highly desirable to establish when a fastener is driven into a supporting surface by a piston, is that the driving face of the piston be as close as possible, and preferably in abutting contact with the head of the fastener at the start of the work stroke of the piston. This means that the fastener preferably contacts the driving face of the piston when the piston is in its driving position. This condition is met when the fastener itself is used to return the piston from its driven position to its driving position, but it is not necessarily achieved with any of the other prior art piston return alternativaes described above.

In the tool of this invention, the muzzle bushing is used to return the piston from the driven position to the driving position. The tool of this invention is constructed with a tilting muzzle bushing, i.e., a muzzle bushing which pivots from a first position, wherein the muzzle bushing bore is coaxial with the piston stem axis, to a second position wherein the muzzle bushing bore is disposed at an angle to the piston stem axis. The muzzle bushing is mounted on a slide which can be pulled forward away from the tool housing to a forward position wherein the muzzle bushing is free to pivot to its second position. In the second position, the breechward end of the muzzle bushing bore is accessible so that a fastener may be inserted into the muzzle bushing bore through the breechward end thereof. In this manner the head of the fastener can be positioned substantially flush with the breechward end of the muzzle bushing.

When the muzzle bushing is in the second position, the breechward end surface of the muzzle bushing is positioned in axial alignment with the driving face of the piston.

Provision is made to hold the muzzle bushing in the second position so that when the muzzle bushing and slide are moved breechwardly toward the tool housing, the muzzle bushing contacts the driving face of the piston and pushes the piston back into the tool barrel to its driving position. When the piston is just short of its driving position, the muzzle bushing is cammed or otherwise returned to its first position, and during this camming movement, the final increment of piston return movement is accomplished. During final pushdown of the tool against a work surface, the muzzle bushing telescopes into a portion of the tool housing as the firing pin is cocked to ready the tool for firing.

The piston return operation can be accomplished by manually grasping the muzzle bushing slide and pulling it breechward toward the tool housing, or, it can be accomplished by pressing the tilted muzzle bushing against the work surface, whereby piston return and firing pin cocking are accomplished in one extended pushdown manuever. This invention provides for full piston return, and also ensures that the piston driving face will always be as close as possible to the fastener head when the tool is fired.

It is, therefore, an object of this invention to provide a piston type fastener driving tool wherein the muzzle bushing is used to return the piston from a driven position to a driving position.

It is a further object of this invention to provide a tool of the character described wherein the muzzle bushing is of the tilting type, and wherein the tilted muzzle bushing is carried on a slide reciprocally movably mounted on the tool housing.

It is another object of this invention to provide a tool of the character described wherein the tilted muzzle bushing contacts the driving face of the piston during the piston return operation.

It is an additional object of this invention to provide a tool of the character described wherein the fastener head and driving face of the piston are as close as possible to each other when the tool is fired.

These and other objects and advantages of the tool of this invention will become more readily apparent from the following detailed description of a preferred embodiment thereof, taken in conjunction with the accompanying drawings, in which.

Figure 3:
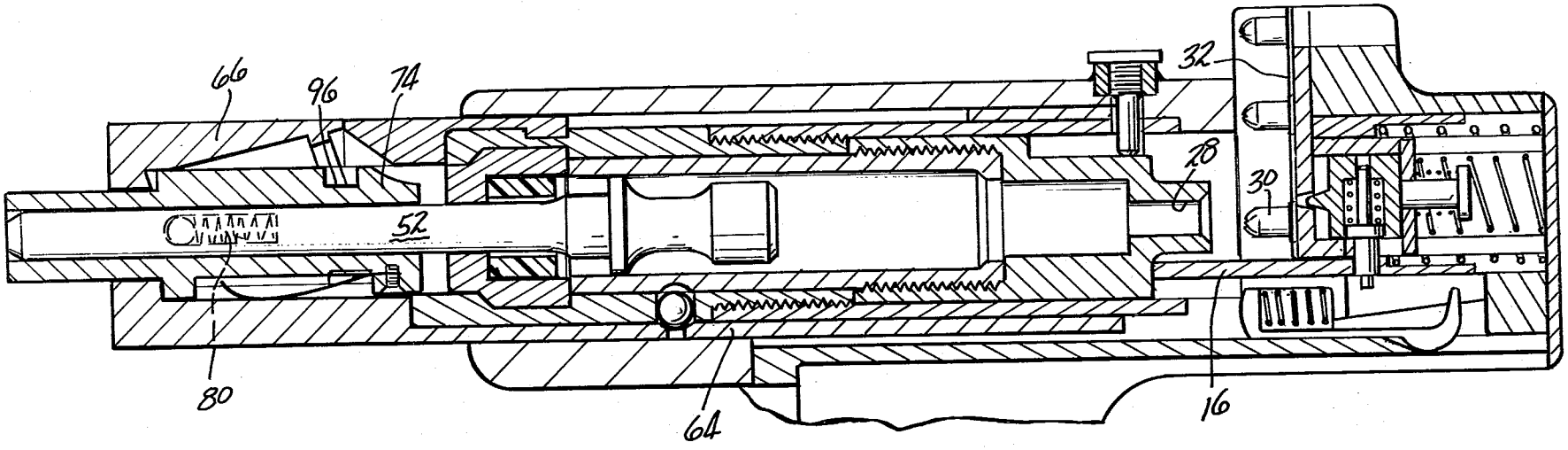
FIG. 3 is an axial sectional view similar to FIG. 2, but showing the tool after it has been withdrawn from contact with the supporting surface to open the breech of the tool.
Figure 4:
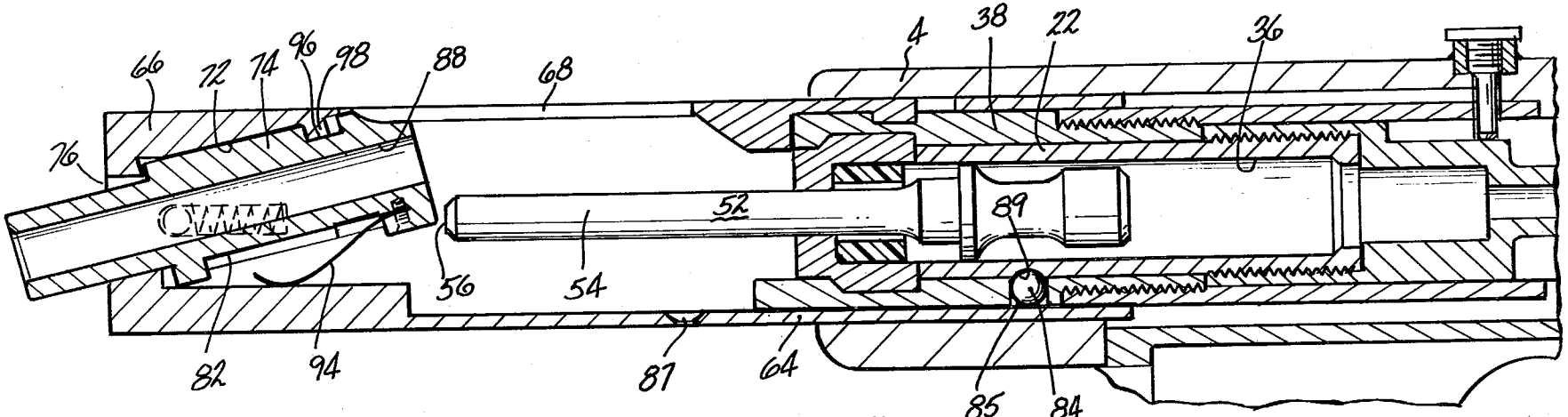
Figure 5:
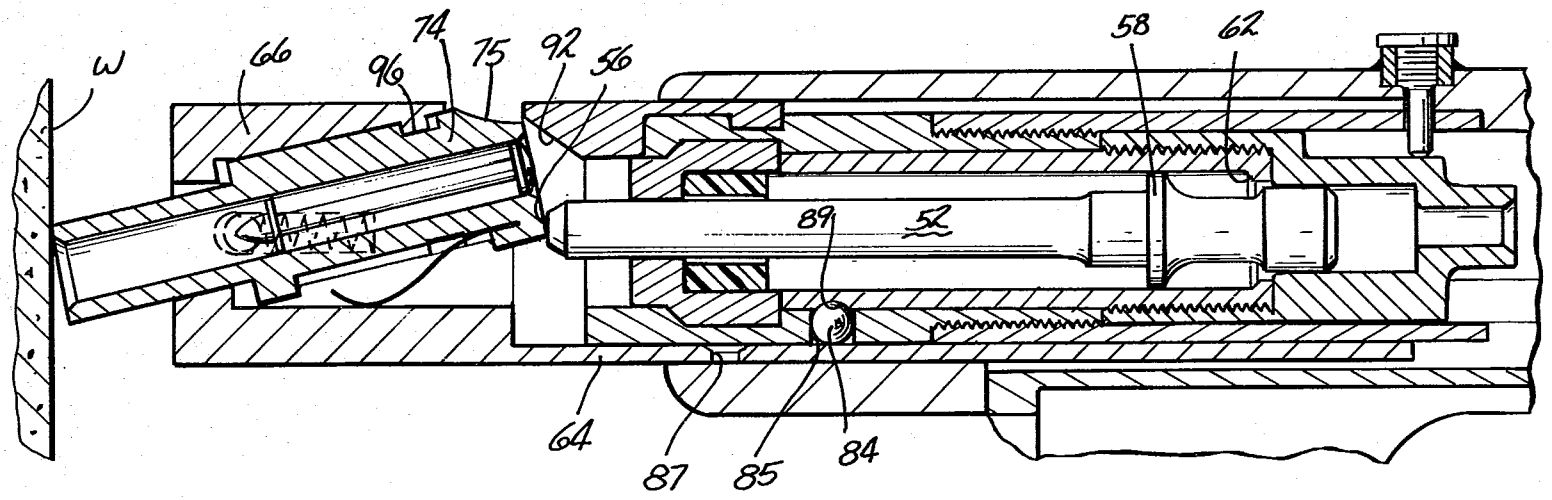

FIG. 4 is an axial sectional view similar to FIG. 3 but showing the muzzle bushing slide pulled forward and showing the muzzle bushing in its tilted position; and FIG. 5 is a sectional view similar to FIG. 4 but showing the fastener positioned in the muzzle bushing bore, and showing how breechward movement of the muzzle bushing slide and tilted muzzle bushing serves to return the piston to its driving position.

Figure 1:
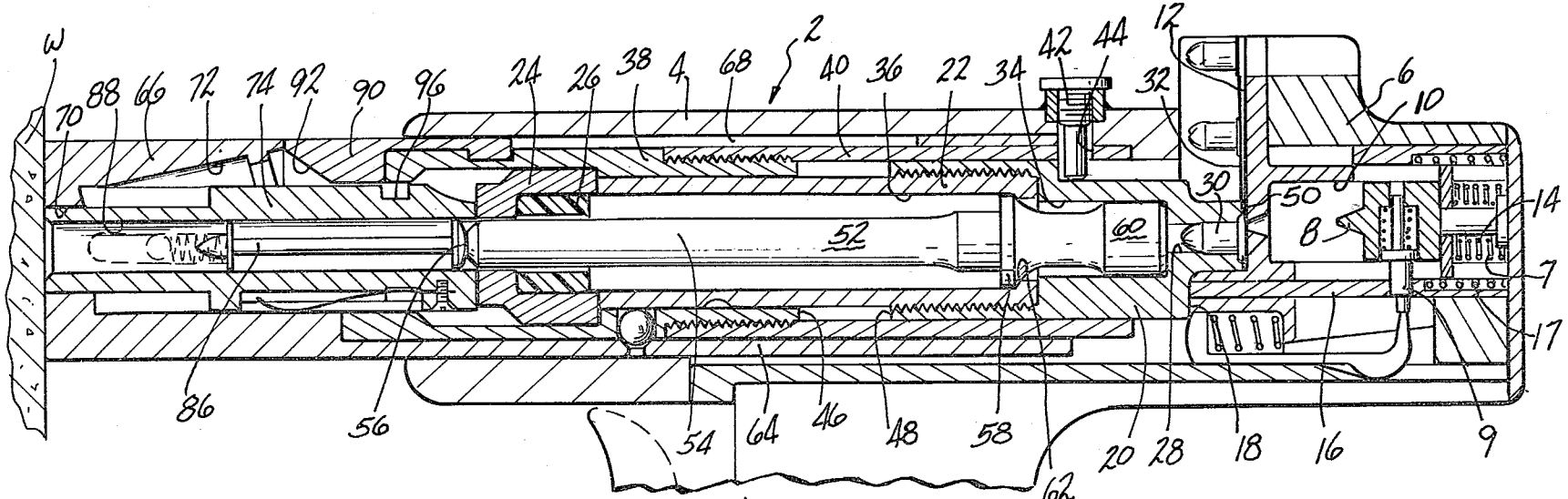
FIG. 1 is an axial sectional view of a preferred embodiment of the pertinent portion of a fastener driving tool formed in accordance with this invention, the tool being shown in its full push down, ready to fire condition.

Referring now to the drawings, there is shown in FIG. 1 a preferred embodiment of a piston tool, denoted generally by the numeral 2, formed in accordance with this invention. The tool 2 includes a housing 4 having a breech closure portion 6. In the breech closure 6 there is mounted a firing pin 8 which is in a bore 10 and is normally retracted from the face 12 of the breech closure 6. The firing pin 8 is biased to the retracted position by a return spring 14. A firing pin spring 7 is compressed when the tool is pressed against a work surface W. The firing pin 8 includes a sear pawl 9 which engages a cocking slide 16. The cocking slide 16 contacts the breechward face 18 of the barrel breech member 20, the slide 16 moving rearward when the barrel breech member 20 moves rearward in response to push down of the tool 2. This rearward movement of the slide of is what cocks the firing pin 8 and compresses the firing pin spring. The slide 16 is also provided with a spring 17 which biases the slide 16 in a muzzleward direction. A conventional trigger mechanism may be used to disconnect the firing pin sear pawl from the cocking slide 16 to fire the tool 2.

The barrel assembly of the tool 2 includes the barrel breech member 20, a barrel sleeve 22, and an annular buffer housing 24 which contains an elastomeric buffer member 26. The breech member 20 contains the firing chamber 28 in which the cartridges 30 are disposed when the tool is fired, the cartridges 30 being carried in a magazine 32. The firing chamber 28 opens into a gas expansion chamber 34, which, in turn, opens into the main barrel bore 36. The barrel assembly is housed in a sleeve assembly having a muzzleward member 38 and a breechward member 40. An assembly screw 42 which projects through an opening 44 in the breechward member 40 of the sleeve assembly fixes the latter in the housing 4. The barrel assembly is reciprocally slidably movable in the sleeve assembly with the muzzleward limit of slidable movement being governed by engagement between opposing surfaces 46 on the muzzleward sleeve assembly member 38, and 48 on the barrel breech member 20. The breechward limit of such slidable movement of the barrel assembly is governed by engagement between the rearward face 50 of the barrel breech member 20 and the magazine 32.

The fastener driving piston 52 is reciprocally slidably disposed in the barrel bore 36. The piston 52 includes a stem portion 54, the muzzle end 56 of which forms the fastener driving face of the piston 52. The piston also includes a radially enlarged head flange 58, and a breechward extending portion 60 which projects into the gas expansion chamber 34. A shoulder 62 in the barrel sleeve 22 engages the breechward face of the head flange 58, to properly position the piston 52 in the barrel bore 36 for firing.

Reciprocally slidably mounted on the sleeve assembly is a muzzle bushing slide 64. The slide 64 has formed at its muzzleward end a muzzle bushing housing 66. The slide 64 is a generally cylindrical member which has a window 68 cut through it. The muzzle bushing housing 66 has a compound through passage having a first portion 70 which is coaxial with the axis of the piston 52, and a second portion 72 whose axis diverges from the axis of the first portion 70 in the breechward direction. The muzzle bushing 74 is mounted in the muzzle bushing housing 66 for limited axial displacement therein. The axial displacement of the muzzle bushing 74 within the muzzle bushing housing 66, as well as pivoting movement of the muzzle bushing 74 within the muzzle bushing housing 66, is accomplished by means of a pair of trunnions 76 which extend outwardly from opposite sides of the muzzle bushing 74 and which are received in a pair of axially elongated slots 78 formed in the side wall of the through passage of the muzzle bushing housing 66. The trunnions 76 are biased in a muzzleward direction by springs 80. Thus, the muzzle bushing 74 is biased muzzleward in the muzzle bushing housing 66. A fastener 86 is disposed in the bore 88 of the muzzle bushing 74. It will be noted that the head of the fastener 86 is disposed very closely adjacent to the driving face 56 of the piston 52. A cam block 90 having a camming surface 92 is fixed to the muzzleward end of the muzzleward sleeve assembly member 38.

As previously noted, in FIG. 1, the tool 2 is shown in its full push down position, pressed against a work surface W and ready to imbed fastener 86 in the work surface. In this condition, the cocking slide spring and firing pin spring are compressed, the cartridge 30 is in the firing chamber 28, the piston 52 is in its driving position, the muzzle bushing 74 extends partly into the inside of the muzzleward sleeve assembly member 38, and the muzzle bushing trunnion springs 80 are compressed.

Figure 2:
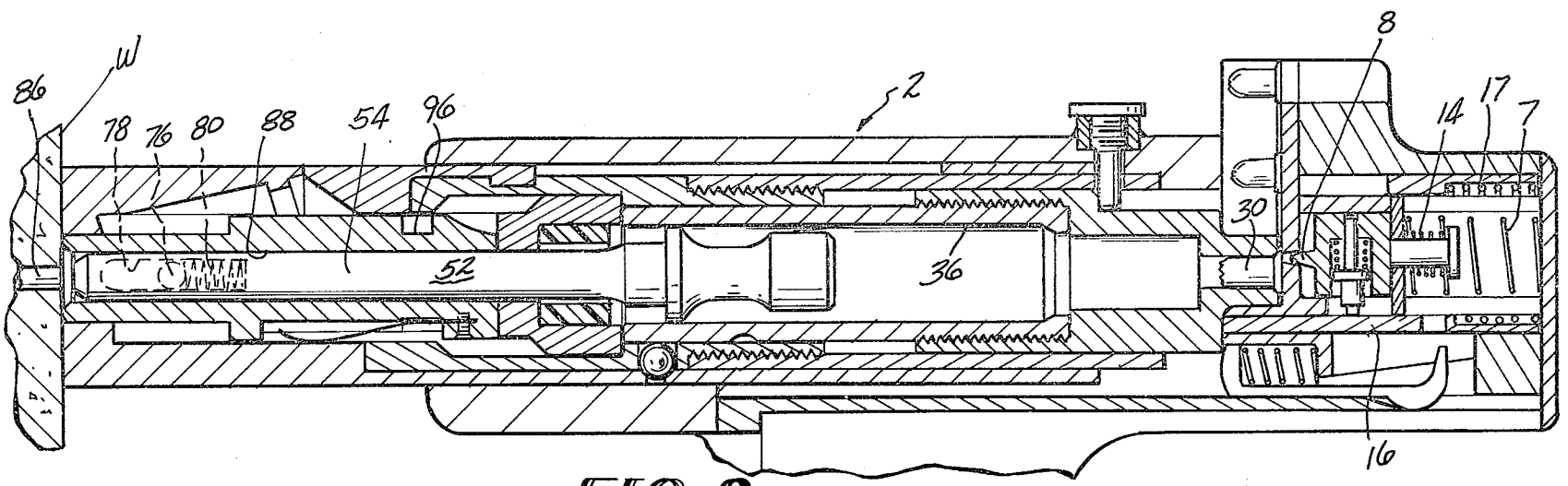
FIG. 2 is an axial sectional view, similar to FIG. 1, but showing the tool after it has been fired to drive the fastener into the supporting surface.

Referring now to FIG. 2, the condition of the tool 2 is shown after it has been fired to imbed the fastener 86 in the work surface W. When the tool is fired, the firing pin 8 is momentarily impelled forward against the cartridge rim to fire the cartridge, and then the firing pin 8 is returned to its retracted position by the return spring 14. When the cartridge 30 is fired, the combustion gases generated propel the piston 52 through the barrel bore 36 to drive the fastener 86. The position of the piston 52 shown in FIG. 2 is its driven position wherein the piston stem 54 projects into the muzzle bushing bore 88.

Referring now to FIG. 3, the condition of the tool is shown after it has been withdrawn from the work surface subsequent to firing. It will be noted that the spring-biased cocking slide 16 pushes the barrel assembly muzzleward thereby moving the cartridge chamber 28 away from the fired cartridge 30. Thus, the cartridge 30 is extracted and the magazine 32 may be indexed to align a fresh cartridge with the firing chamber 28 for the next firing of the tool. The muzzle bushing slide 64 and housing 66 do not move muzzleward when the tool is lifted away from the work surface; however, the trunnion springs 80 cause the muzzle bushing 74 to slide forward and protrude somewhat from the housing 66. It will be noted that the piston 52 remains in its fired position within the barrel assembly.

Referring now to FIG. 4, the condition of the tool is shown when the muzzle bushing slide 64 has been pulled forward to its maximum extent. To accomplish this step, the muzzle bushing housing 66 is grasped and pulled forward away from the tool housing 4. This causes the muzzle bushing slide 64 to move forward and project from the housing 4. Forward movement of the muzzle bushing housing 66 continues until the muzzle bushing 74 has been advanced sufficiently to withdraw the piston stem 54 from the muzzle bushing bore 88. When this occurs, a blade spring 94 mounted in a slot 82 in the muzzle bushing 74 causes the muzzle bushing 74 to pivot about the trunnions 76 so that the muzzle bushing 74 tilts into the second divergent portion 72 of the muzzle bushing housing passage, as shown in FIG. 4. In the tilted position, the breechward end of the muzzle bushing bore 88 is accessible via the slide window 68 so that a new fastener may be inserted into the muzzle bushing bore 88. Also in the tilted position, the breechward end of the muzzle bushing 74 is aligned with the driving face 56 of the piston 52. Thus, after the new fastener is inserted into the muzzle bushing bore 88, the slide 64 and housing 66 are returned breechward to bring the breechward end of the muzzle bushing 74 into contact with the driving face 56 of the piston 52. After such contact is established, continued breechward movement of the slide 64, housing 66 and muzzle bushing 74 operates to push the piston 52 breechward and return it to its driving position within the barrel assembly. During the return movement of the piston 52, the barrel sleeve 22 is temporarily locked to the muzzleward sleeve member 38 by means of a ball detent 84 which is disposed in a hole 85 formed in the muzzleward sleeve member 38. When the muzzle bushing slide 64 is moved forward, the ball detent 84 is pushed up out of a recess 87 in the slide 64 into a blind hole 89 in the barrel sleeve member 22 whereby the barrel sleeve member 22 is prevented from moving axially relative to the muzzleward sleeve member 38. In this way, the frictional force generated between the piston 52 and barrel bore 36 as the piston 52 is returned to its driving position does not move the barrel sleeve member 22. Once the recess 87 is returned to registry with the hole 85, as the muzzle bushing slide 64 moves breechward, the ball 84 will move into the recess 87 and out of the hole 89 thereby freeing the barrel assembly for push down movement. The breechward movement of the slide 64, housing 66 and muzzle bushing 74 may be accomplished in one of two different ways. The housing 66 may be grasped manually and pulled or pushed back toward the tool housing 4, or, the muzzle end of the muzzle bushing 74 can be pushed directly against the work surface as the beginning part of the overall tool pushdown for firing. Thus, the piston 52 can be returned by tool pushdown. In this manner, pushdown accomplishes return of the muzzle bushing 74, housing 66 and slide 64, as well as the piston 52, and also cocks and readies the tool for firing. In order to ensure proper positioning of the muzzle bushing 74 for contact with the driving face 56 of the piston 52 as the muzzle bushing 74 is pressed against the work surface, there is provided a groove 96 in the muzzle bushing 74, which groove 96 receives a projecting rib 98 formed on the housing 66 when the muzzle bushing 74 pivots to its titled position. The muzzleward sides of the groove 96 and rib 98 contact each other during pushdown to provide a stop which holds the muzzle bushing 74 in proper position for contact with the driving face 56 of the piston 52.

Referring now to FIG. 5, the condition of the tool is shown during the piston return operation as the muzzle bushing 74 is about to cam back to the first position shown in FIG. 1. It will be noted that the slide 64 and muzzle bushing housing 66 have been moved breechward to an extent wherein the tilting muzzle bushing 74 has returned the piston 52 breechward within the barrel assembly toward its driving position, and wherein the piston head flange 58 is closely adjacent to the barrel sleeve shoulder 62. Furthermore, the muzzle bushing 74 has moved breechward sufficiently to bring a breechward surface 75 of the muzzle bushing 74 into contact with the camming surface 92. At the time that camming of the muzzle bushing 74 begins, it will be noted that the muzzle bushing 74 is still in contact with the driving face 56 of the piston 52. It will be readily appreciated that as breechward movement of the slide 64, housing 66 and muzzle bushing 74 continues from the position shown in FIG. 5, the muzzle bushing 74 will concurrently continue the return movement of the piston 52 to its driving position and continue the camming movement to the first position wherein the muzzle bushing 74 is coaxial with the piston 52. At the time that such coaxiality is realized, the return movement of the piston 52 will be complete, and the piston head flange 58 will contact the barrel sleeve shoulder 62. Piston return will thus be completed and pushdown can be continued to return the tool components to the position shown in FIG. 1 wherein the tool will once again be ready for firing.

It will be readily appreciated that the tool of this invention includes an improved mechanism for accomplishing piston return and concurrently positioning the fastener to be driven as close as possible to the driving face of the piston. Piston return can be accomplished by the pushdown operation of the tool against the work piece surface, which pushdown is used to cock the tool and ready it for firing.

Since many changes and variations of the disclosed embodiment of the invention may be made without departing from the inventive concept, it is not intended to limit the invention otherwise than as required by the appended claims.

What is claimed is:

1. In a powder-actuated fastener driving tool of the type having a housing; means within said housing forming a barrel with a bore; and a fastener driving piston reciprocally slidably disposed in said barrel bore for movement between a breechward driving position and a muzzleward driven position; a piston return mechanism comprising:

a. slide means mounted on said housing and reciprocally slidably movable thereon in breechward and muzzleward directions;

b. a muzzle bushing mounted on said slide means, said muzzle bushing having a bore for the reception of a fastener to be driven by said piston, and said muzzle bushing being pivotable on said slide means between a first position wherein said muzzle bushing bore is coaxial with said piston, and a second position wherein said muzzle bushing bore is disposed at an angle with respect to the axis of said piston;

c. means for holding said muzzle bushing in said second position;

d. contact means on said muzzle bushing for engaging a surface on said piston, when the latter is in said driven position when said slide means is in a muzzleward position, and said muzzle bushing is in said second position, whereby return movement of said slide means in a breechward direction will move said piston from said driven position toward said driving position;

e. means permitting access to a breechward end of said muzzle bushing bore whereby a fastener can be inserted into said muzzle bushing bore when said muzzle bushing is in said second position; and f. means for returning said muzzle bushing from said second position to said first position as said piston approaches said driving position.

2. A powder-actuated fastener driving tool comprising:

(a) a housing having a breech end;

(b) a barrel reciprocally slidably movably mounted in said housing, said barrel having a bore, and a cartrige-receiving chamber at one end thereof adjacent said breech end of said housing, said barrel being movable between breech closed and breech open positions;

(c) a piston disposed in said barrel bore for movement between driving and driven positions;

(d) a muzzle bushing having a bore for receiving a fastener to be driven;

(e) a slide mounted on said housing for reciprocal breechward and muzzleward movement with respect to said housing;

(f) means mounting said muzzle bushing for sliding and pivotal movement on a muzzleward end portion of said slide, said muzzle bushing being mounted on said slide for pivotal movement between a first position wherein said muzzle bushing bore is coaxial with said piston, and a second position wherein said muzzle bushing bore is disposed at an angle with respect to said piston;

(g) means providing access to a breechward end of said muzzle bushing bore for insertion of a fastener into said muzzle bushing bore when said muzzle bushing is in said second position;

(h) means for causing said muzzle bushing to piviot to said second position when said slide is moved in a muzzleward direction with respect to said housing;

(i) means on said muzzle bushing for engaging a surface on said piston when the latter is in said driven position and said muzzle bushing is in said second position whereby subsequent breechward movement of said slide will cause return movement of said piston toward said driving position; and (j) means for returning said muzzle bushing from said second position to said first position when said piston has returned to said driving position.

3. The tool of claim 2, further comprising means for preventing relative movement between said barrel and said housing when said barrel is in said breech open position and said piston is being returned to said driving position.

4. In a powder-actuated fastener driving tool of the type having a barrel with a bore, and a piston reciprocally slidably disposed in said barrel bore for movement between a breechward driving position and a muzzleward driven position, a piston return mechanism comprising:

(a) a muzzle bushing having a bore, said muzzle bushing being mounted on a slide movably mounted on said tool for movement between a first position wherein a breechward end of said muzzle bushing bore is closely adjacent to a fastener driving face on said piston when the latter is in said driving position, and a second position wherein said breechward end of said muzzle bushing bore is offset from said fastener driving face on said piston;

(b) means providing access to said breechward end of said muzzle bushing bore when said muzzle bushing is in said second position for insertion of a fastener into said muzzle bushing bore via said breechward end thereof; (c) piston return means on said slide for engaging said fastener driving face on said piston when said slide is in said second position and said piston is in said driven position whereby subsequent movement of said slide from said second position to said first position causes return movement of said piston from said driven position to said driving position; and (d) means for disengaging said piston return means from said fastener driving face of said piston when said slide approaches said first position.

5. In the tool of claim 4, means for holding said barrel in a breech open position when said slide is moved from said second position to said first position.

6. In a powder-actuated fastener driving tool of the type having a barrel with a bore, and a piston reciprocally slidably disposed in said barrel bore for movement between a breechward driving position and a muzzleward driven position, a piston return mechanism comprising:

(a) a muzzle bushing having a bore, said muzzle bushing being mounted on a slide movably mounted on said tool for movement between a first breechward position wherein said piston, when in said driven position, extends into said muzzle bushing bore, and a second muzzleward position wherein said muzzle bushing bore is open for receipt of a fastener and clear of said piston when the latter is in said driven position;

(b) piston return means on said slide for engaging a fastener driving face on said piston when said slide is in said second position and said piston is in said driven position whereby return of said slide to said first position causes return of said piston to said driving position; and (c) means for disengaging said piston return means from said fastener driving face of said piston when slide approaches said first position.

7. The tool of claim 6, wherein said muzzle bushing is pivotally mounted on said slide for movement between a coaxial position wherein said muzzle bushing bore is coaxial with said piston, and a tilted position wherein said muzzle bushing bore is disposed at an angle with respect to said piston; means for biasing said muzzle bushing toward said tilted position when said slide is in said second position; and wherein said piston return means comprises a breechward surface on said muzzle bushing.

* * * * *